United States Patent [19]

Barnett et al.

[11] 4,228,704

[45] Oct. 21, 1980

[54] MARINE RISER TOOL

[75] Inventors: Robert D. Barnett, Magnolia; Charles D. Morrill, Bellaire; Andre H. Drouin, Houston, all of Tex.

[73] Assignee: McEvoy Oilfield Equipment Company, Houston, Tex.

[21] Appl. No.: 909,091

[22] Filed: May 24, 1978

Related U.S. Application Data

[63] Continuation of Ser. No. 694,187, Jun. 9, 1976, abandoned.

[51] Int. Cl.[3] ..... B25B 13/46

[52] U.S. Cl. ..... 81/57.39

[58] Field of Search ..... 81/54, 57.39, 57.46, 81/90 B, 90 C, 90 F, 125.1, 57.32, 57; 29/240, 266, 258, 259, 260, 256; 254/27, 100

[56] References Cited

U.S. PATENT DOCUMENTS

| | | | |
|---|---|---|---|
| 378,299 | 2/1888 | Finch | 81/57.32 |
| 455,606 | 7/1891 | Byrne | 81/90 B |
| 977,018 | 11/1910 | Kopietz | 29/260 |
| 1,836,716 | 12/1931 | Huthsing | 81/90 D |
| 2,836,090 | 5/1958 | Ray | 81/54 |
| 3,378,910 | 4/1968 | Are | 29/256 |
| 3,955,447 | 5/1976 | Parker | 81/57.39 |

FOREIGN PATENT DOCUMENTS

| | | | |
|---|---|---|---|
| 552230 | 1/1923 | France | 81/57.32 |

*Primary Examiner*—James L. Jones, Jr.
*Attorney, Agent, or Firm*—Ned L. Conley; David Alan Rose; David M. Ostfeld

[57] ABSTRACT

A tool for preloading a marine riser connection having a first member, a second member and a nut having a lug extending therefrom, the connection being made up by rotating the nut with respect to the first member so as to place the nut in tension, such tension operating to hold the first and second members together in compression, is disclosed. The tool includes a lug holder for holding the lug, a block for engaging a reference member attached to the first member, and a device for forcing the lug holder and block apart so that the nut is rotated with respect to the first member.

1 Claim, 4 Drawing Figures

74
94
340
320
318
345
214
342
334
92
96
347
343
322
348
332
350
366
368
333
336
352
358
360
346
324
344
330
328
364
362
326
354
250
256
254

358
366
367
368
324

360
362
364
356
354

345
340
347
342
334
333
336
330
332
338
326
328

MARINE RISER TOOL

CROSS REFERENCE TO RELATED APPLICATIONS

This is a continuation of application Ser. No. 694,187, filed June 9, 1976, now abandoned.

BACKGROUND OF THE INVENTION

1. Field of the Invention

The present invention relates generally to marine riser connections, and more particularly to a tool for preloading a marine riser connection. The invention has been found to be particularly useful in the connection of riser sections in a long string of low pressure service pipe between a floating vessel, such as, for example, a semisubmersible rig, and the ocean bottom, and hence, will be discussed with particular reference thereto. However, the invention is also applicable to other types of risers requiring sealing and high resistance to structural yield as the result of stress oscillation.

2. Decription of the Prior Art

For a description of the prior art, see U.S. Pat. No. 4,097,069, issued June 27, 1978 to Charles D. Morrill, the following portions of which are incorporated herein by reference: column 1, line 61 through column 5, line 2, under the heading "Description of the Prior Art."

SUMMARY OF THE INVENTION

The present invention is a portable, mechanical preload tool for preloading a marine riser connection having a first member, a second member and a nut having a lug extending therefrom, the connection being made up by rotating the nut with respect to the first member so as to place the nut in tension, such tension operating to hold the first and second members together in compression. The tool includes a lug holder for holding the lug, a block for engaging a reference member attached to the first member, and a device for forcing the lug holder and block apart so that the nut is rotated with respect to the first member.

BRIEF DESCRIPTION OF THE DRAWINGS

For a further understanding of the nature and objects of the present invention, reference should be had to the following detailed description, taken in conjunction with the accompanying drawings, in which like parts are given like reference numerals and wherein:

FIGS. 1, 2, 3, 4, 5 and 6, and the description thereof found in column 5, lines 39–56, of U.S. Pat. No. 4,097,069, issued June 27, 1978, to Charles D. Morrill, are incorporated herein by reference;

FIG. 1 is a side view, partially in elevation, partially in cross-section, partially in phantom line of the preload tool of the preferred embodiment of the apparatus of the present invention;

FIG. 2 is a front view of the block of the preload tool of the preferred embodiment of the apparatus of the present invention; and FIG. 3 is an end elevation of the preload tool of the preferred embodiment of the apparatus of the invention; and FIG. 4 is a side cross-sectional view of the body of the preload tool of the preferred embodiment of the apparatus of the present invention.

DETAILED DESCRIPTION OF THE PREFERRED EMBODIMENT

Introduction

The preferred embodiment of the marine riser connector of the present invention may be used to connect low pressure marine riser sections between a floating drilling vessel and the ocean bottom wherein it is important that the connector, using a male and female member held by a nut, not experience fatigue failure under load oscillations of the riser sections. A particularly important area of application of the present invention is in deep wells having blow out equipment on the ocean bottom wherein positive seals must be kept at all times and provision must also be made for supporting well control choke and kill lines.

In the preferred embodiment of the present invention, the riser section connection is accomplished through the use of a female member, attached to one pipe section, placed in compressive relationship with a male member, attached to another pipe section, by a nut. The nut is placed in tension by a tool so that when load equal to the yield strength of the pipe is applied to the pipe sections, the male and female members remain abutting. A platform connected to the male member is used, in conjunction with the tool, to preload the connection to the appropriate compressive and tensile force.

A sealing element is provided on the male member to form a seal against an internal wall of the female member to prevent leakage.

The members and nut support choke and kill line sections.

STRUCTURE AND ITS METHOD OF USE

For a detailed description of various portions of the marine riser connection, see U.S. Pat. No. 4,097,069, issued June 27, 1978, to Charles D. Morrill, the following portions of which are incorporated herein by reference: column 6, line 36 through column 12, line 54 under the heading "Structure and its Method of Use."

Make-up Tool

Figure 1:
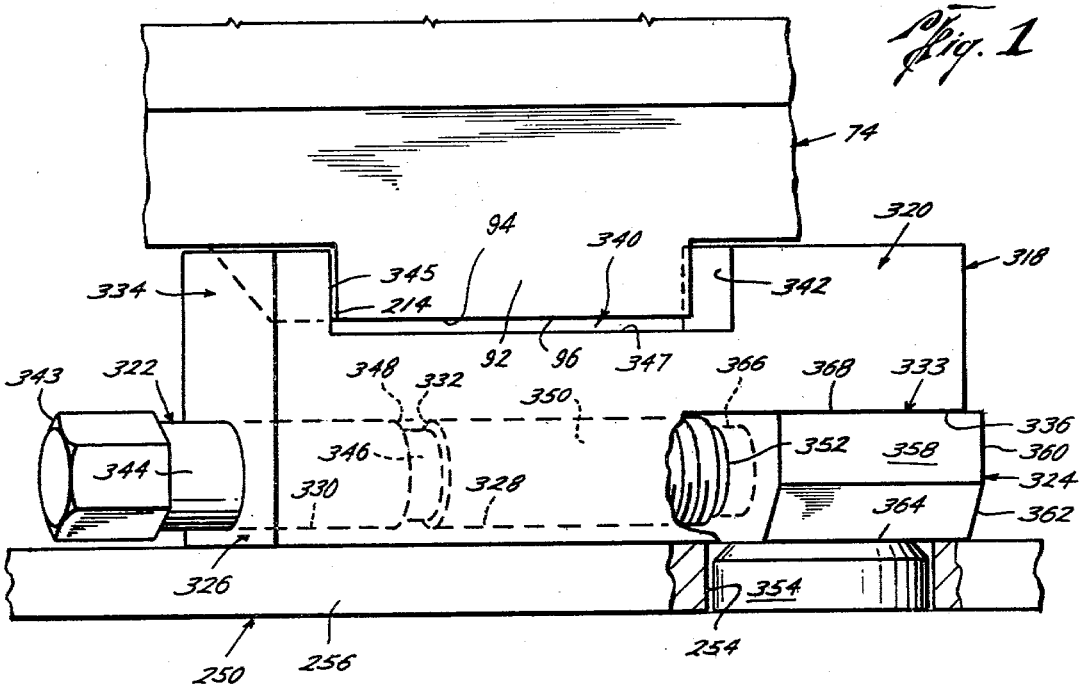
Figure 2:
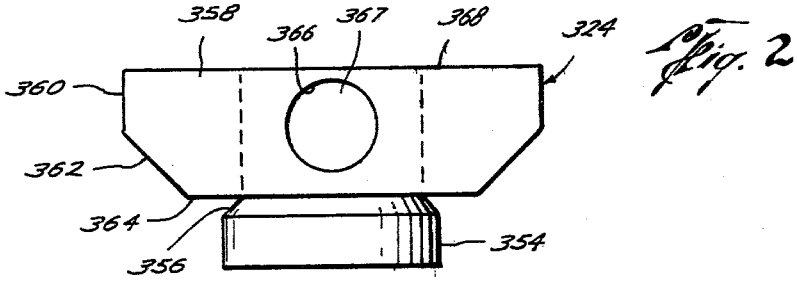
Figure 3:
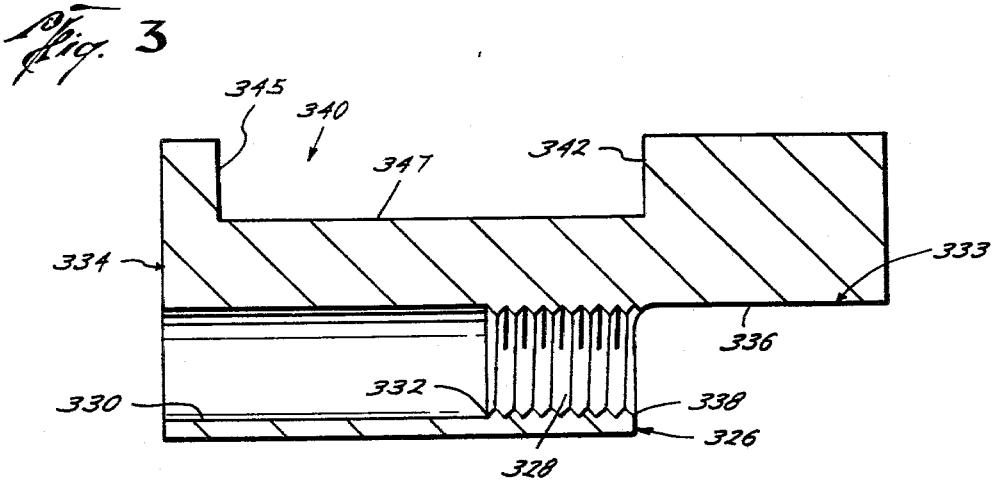
Figure 4:
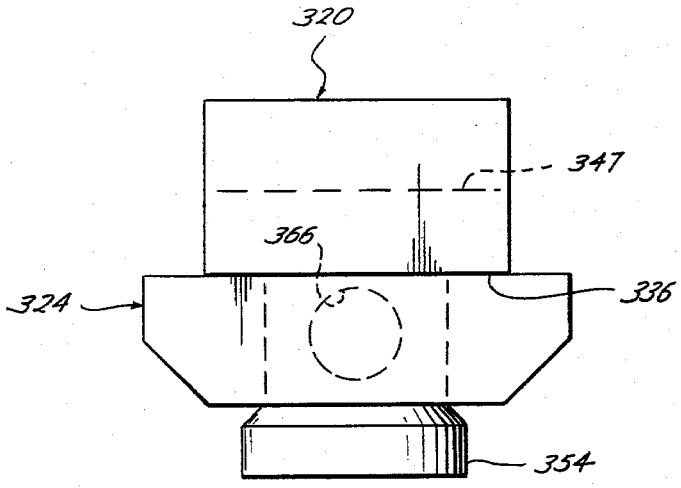

Referring now to FIGS. 1, 2, 3, and 4, there is shown make-up tool 318 used for forcing shoulder 76 of lugs 92 of nut 74 in contact with surface 80 of lugs 88 of male member 62 to preload connection 36. Make-up tool 318 comprises moving means for example lug holder 320, screw pin 322, and block 324 the latter two being considered, for example, forcing means and the former being considered, for example, engagement means.

Lug holder 320 has lower portion or member 326 and upper portion or member 334. Lower portion 326 includes a threaded bore 328 extending longitudinally therethrough. Smooth counterbore 330 is formed substantially coaxial with bore 328 by drilling or other means. Counterbore 330 is of larger diameter than bore 328 forming thread shoulder 332 therebetween. Lug holder 320 also includes corner section 333 which is a cut out portion of lower section 326. It has horizontal surface 336 and vertical surface 338. Threaded bore 328 terminates at vertical surface 338.

Upper portion 334 includes open rectangular cut out 340 having vertical load bearing side 342, vertical non-load bearing side 345, and horizontal upward facing bottom 347. The length of vertical sides 342, 345 and the width of bottom 347 are such that lug 92 may fit loosely into open rectangular cut out 340.

Screw pin 322 includes head 343 suitable for mechanical or hydraulic turning, such as, for example, a hexogonal head. Screw pin 322 also includes smooth cylindrical body 344 attached to and substantially coaxial with head 343. Body 344 is dimensioned to permit telescopic enclosure within counterbore 330 but not pass beyond shoulder 332. Screw pin 322 further includes smooth reduced diameter section 346 attached to and substantially coaxial with body 344. Substantially curved shoulder 348 is formed at the connection between cylindrical body 344 and section 346. Reduced diameter section 346 is dimensioned to permit its passage telescopically within the inner diameter of the threads of threaded section 328. Screw pin 322 also includes threaded bolt 350 having thread of the same pitch as threaded section 328. Threaded bolt 350 is attached to and substantially coaxial with reduced diameter section 346. Threaded bolt 350 is dimensioned and pitched to pass through smooth section 330 and engage threaded section 328. Screw pin 322 further includes bolt extension 352 attached to and substantially coaxial with threaded bolt 350. Bolt extension 352 is dimensioned to permit it to telescopically pass within the inner diameter of the threads of threaded section 328.

Block 324 comprises cylindrical extension section 354 attached by swedge section 356 to main body 358. The diameter of extension section 354 is such that it may be inserted within holes 254 of horizontal member 256 of lower platform section 250. Main body 358 includes upper horizontal surface 368, upper vertical sides 360, lower beveled sides 362, and horizontal bottom 364. Horizontal bottom 364 connects to swedge section 356. Main body 358 further includes partial bore 366 having face 367 at its interior end. Face 367 and bore 366 are positioned in block 324 to be substantially coaxial with bore 328 when horizontal surface 364 is in substantial contact with horizontal member 256 and cylindrical extension section 354 is in hole 254. Bore 366 is dimensioned to telescopically receive bolt extension 352 but not threaded bolt 350. The length of bolt extension 352 is greater than the depth of partial bore 366 of block 324. The height from horizontal surface 364 to horizontal surface 368 is substantially equal to the length of vertical side 338 of lug holder 320. The width of horizontal surface 364 is such that horizontal surface 364 does not extend into hole 254. During use of the tool, block 324 is held in fixed relation to platform 250 by engagement of extension 354 with the sides of hole 254.

The overall length of bolt 322 from shoulder 348 to the outward facing end of bolt extension 352 is such that when block 324 is fixed with respect to platform 250 and shoulder 348 contacts with shoulder 332, through rotation of head 343, holder 320 will have moved, such as, for example, one-quarter of an inch, with respect to block 324. The distance of the movement of holder 320 relative to block 324 must be such as to force shoulder 76 of lug 92, through load surface 342, to climb surface 80 and preload the connection to the desired value set by the position of locks 220.

Materials of Construction and Coatings

Nut 74, male member 62, and female member 64 are usually made of alloy steel.

Further, parts in sliding contact should be of different hardness to prevent galling. Bearing in mind the principle that a chain is no stronger than its weakest link, the materials for the nut 74, male member 62, and female member 64 should be chosen to carry the desired preload. For example, the preload may be set so that the pipe yields in tension before the connector faces 68, 126 move apart, thereby insuring that the connector will be at least as strong as the pipe. For the preload criteria given in this example and presuming riser sections 34 comprise pipe whose size is eighteen and three-fourths inches by seven-sixteenth inch wall thickness and whose composition has a yield strength of 52,000 pounds per square inch, a suitable selection for the yield strength of the nut would be 120,000 pounds per square inch and for the yield strength of the male member 62 and female member 64 would be 80,000 pounds per square inch.

Method of Use

Column 14, lines 24 through 63, the first two paragraphs under the heading "Method of Use," of U.S. Pat. No. 4,097,069, issued June 27, 1978, to Charles D. Morrill, are incorporated herein by reference.

Nut 74 is then rotated relative to platforms 250, 274, 276 and members 62, 64 until lugs 92 contact lugs 88. First and second make-up tools 318, may then be located at opposite sides of nut 74 and employed to drive nut 74 to a preloaded condition. To install tools 318, extensions 354 of block 324 of tools 318 are inserted into two holes 254 of lower platform 250 circumferentially spaced apart by 180°. Lug holders 320 are installed with opposite facing lugs 92 bounded by cut outs 340. Screw pin 322 is inserted into counterbore 330 for each and threaded in bore 328 until extension 352 contacts the opposite face 367 of block 324. Force application means (not shown) is then applied to head 343, forcing extension 352 against face 367 and surface 342 of upper portion 334 against side 206 of lug 92. This force will rotate nut 74 clockwise (as viewed from above the female member 64) relative to the rest of the assembly. As shoulder 76 climbs surface 80, the connection will tighten. Nut 74 is thus placed in tension while male 62 and female 64 members are placed in compression, thereby preloading connector 36. The vertical orientation of surfaces 206, 342 prevents a horizontal component of force from being introduced to the connection through the lugs at the location of the make-up tool.

After the connector 36 has been preloaded to the desired load set by the location of locks 220, threaded sections 224 are rotated by head 222 through holes 218 of nut 74. Lugs 226 of screws 220, spaced 180° apart, thereby engage the sides 138 of lugs 88 and prevent any counter clockwise movement of the nut 74 relative to the male member 62. Safety latches 228 are then replaced to prevent the locks 220 from completely backing out. After the nut 74 is locked in place, the make-up tools 318 may be removed.

The connector 36 is disconnected by first disengaging latch 228 and lock bolt 220. The make-up tool 318 is installed as previously described but oriented in the opposite direction for locking. The make-up tool 318 is then operated as previously described until nut 74 can be rotated by hand to the position where lugs 92 align with slots 148 and can be withdrawn. The choke 38 and kill 40 lines should also be disconnected before the components of the connection are disengaged.

Although the system described in detail supra has been found to be most satisfactory and preferred, many variations in structure and method are possible. For example, hydraulic actuation of nut 74 to cause engagement of lugs 88 with lugs 92 may be used. A gear mechanism with a rachet mounting could be used to preload the connection 36. Male member 62 and female member 64 could be inverted. Any materials having sufficient yield factors could be used based on the criteria previously discussed. The lock may be two tabs with a bolt therebetween. Also, a hydraulic driven tool may be used for actuation of nut 74 to cause engagement of lugs 88 with lugs 92. The hydraulic tool would have alternate moving, forcing means such as two hydraulic actuators mounted on a U-shaped frame that could be placed around the nut 74. The U-shaped frame would have a pin in each leg to fit in two holes 254 of platform 250 circumferentially spaced apart by 180°. The hydraulic actuators would grasp the nut 74 at opposite facing lugs 92. One actuator would pull while the second would push on the lugs 92 to rotate the nut 74 clockwise relative to the rest of the assembly.

The above are merely exemplary of the possible changes or variations.

Because many varying and different embodiments may be made within the scope of the inventive concept herein taught and because many modifications may be made in the embodiment herein detailed in accordance with the descriptive requirements of the law, it should be understood that the details herein are to be interpreted as illustrative and not in a limiting sense.

What is claimed as invention is:

1. A tool for rotating a nut having a lug, the nut being rotatably mounted with respect to a reference member, the reference member having a hole therethrough, comprising:

a first member including engagement means for engaging the lug, a base, a threaded bore longitudinally located below said engagement means, a cutout located at one end of said threaded bore forming an upper surface substantially parallel to said base;

a second member including a peg having a diameter less than the diameter of such reference member hole, a platform attached to said peg, said platform having a width greater than the diameter of such reference member hole, the height of said platform being substantially equal to the height of said cutout, said upper surface being positioned to be supported on the surface of said platform; and a screw jack telescopically received in said threaded bore and engaging the side of said platform.

* * * * *

UNITED STATES PATENT AND TRADEMARK OFFICE

CERTIFICATE OF CORRECTION

PATENT NO. : 4,228,704

DATED : OCTOBER 21, 1980

INVENTOR(S) : ROBERT D. BARNETT; CHARLES D. MORRILL; ANDRE H. DROUIN

It is certified that error appears in the above-identified patent and that said Letters Patent is hereby corrected as shown below:

Column 1, line 62, after "present invention," delete "and".

Column 2, line 48, after "moving means" insert a comma (,).

Column 2, line 48, after "for example" insert a comma (,).

Column 4, line 51, change "placed" to -- leased --.

Column 3, line 2, change "hexo-" to -- hexa- --.

Signed and Sealed this

*Seventeenth* Day of *March 1981*

[SEAL]

*Attest:*

RENE D. TEGTMEYER

*Attesting Officer*

*Acting Commissioner of Patents and Trademark*